US006345951B1

(12) United States Patent
Choi

(10) Patent No.: US 6,345,951 B1
(45) Date of Patent: Feb. 12, 2002

(54) CROSS FLOW FAN OF AN AIR CONDITIONER

(75) Inventor: Weon-Seok Choi, Seoul (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/636,765

(22) Filed: Aug. 14, 2000

(30) Foreign Application Priority Data

Sep. 10, 1999 (KR) ..... 99-38647

(51) Int. Cl.[7] ..... F04D 5/00
(52) U.S. Cl. ..... 415/1; 415/53.1; 416/203
(58) Field of Search ..... 415/119, 53.1, 415/1; 416/178, 187, 203

(56) References Cited

U.S. PATENT DOCUMENTS 4,462,750 A 7/1984 Sugawara et al. ..... 415/54
4,538,963 A * 9/1985 Sugio et al. ..... 416/203
5,197,850 A 3/1993 Shinobu et al. ..... 415/53.1
5,211,219 A 5/1993 Kawabata et al. ..... 165/122
5,573,059 A 11/1996 Hamamoto et al. ..... 165/124
5,588,484 A 12/1996 Baker et al. ..... 165/122
5,924,923 A 7/1999 Chiguchi et al. ..... 454/256
6,149,381 A * 11/2000 Lee ..... 415/53.1

* cited by examiner

*Primary Examiner*—Edward K. Look
*Assistant Examiner*—Richard Edgar
(74) *Attorney, Agent, or Firm*—Robert E. Bushnell, Esq.

(57) ABSTRACT

A cross flow fan of an air conditioner for reducing noise and vibration produced due to a rotation of the cross flow fan, by an improvement in a blade arrangement which has a regularity as a whole and an irregularity as respective units. Such a cross flow fan is installed in an indoor unit of the air conditioner, and has a plurality of blades functioning to circulate an inside air. The blades of the cross flow fan are divided into a plurality of blade groups consisting of a uniform number of blades, and the blades in the same blade group are arranged at uniformly increasing angles, while the pattern of the blade arrangement throughout the complete blade groups is uniformly formed.

20 Claims, 6 Drawing Sheets

CROSS FLOW FAN OF AN AIR CONDITIONER

CLAIM OF PRIORITY

This application makes reference to, incorporates the same herein, and claims all benefits accruing under 35 U.S.C. §119 from an application entitled Crossflow Fan for an Air Conditioner earlier filed in the Korean Industrial Property Office on Sep. 10, 1999, and there duly assigned Serial No.99-38647 by that Office.

BACKGROUND OF THE INVENTION

1. Field of the Invention

The present invention relates to a cross flow fan, and more particularly to a cross flow fan of an air conditioner capable of reducing noise and vibration produced due to a rotation of the cross flow fan, by the improvement in an arrangement of blades on the cross flow fan.

2. Discussion of Related Art

Generally, a separate type air conditioner includes indoor and outdoor units connected with each other. The indoor unit includes an evaporator and a blower for circulating air. The blower sucks the inside air to pass the same through the evaporator, and discharges the heat-exchanged air back into the room. For the circulation of the indoor air, the blower is coupled with a driving source. i.e. a motor. The separate type air conditioner employs a cross flow fan as a blower for its indoor unit.

The cross flow fan may have multiple fan blades. The interval between the fan blades is called a fan pitch. In general, the cross flow fans have had considerable noise produced due to the rotation of the cross flow fan. Differing arrangements of the fan blades still produce high noise levels and vibration in the fan even at low frequencies (revolutions per unit of time of the cross flow fan).

An exemplar of the prior art Hamamoto et al. (U.S. Pat. No. 5,573,059, Air Conditioning Machine, Nov. 12, 1996) shows an air conditioning unit with a cross flow fan next to the heat exchanger. Kawabata et al. (U.S. Pat. No. 5,211,219, Air Conditioner, May 18, 1993) shows an air conditioner with a cross flow fan. Sugawara et al. (U.S. Pat. No. 4,462,750, Electric Fan Assembly, Jul. 31, 1984) discloses a cylindrical cross flow fan designed for use in a heating or cooling system. Chiguchi et al. (U.S. Pat. No. 5,924,923, Air Conditioner Indoor Unit, Jul. 20, 1999) discloses an indoor unit in a separate type air conditioner. Baker et al. (U.S. Pat. No. 5,588,484, Refrigeration Fan System, Dec. 31, 1996) discloses a fan system used in air conditioners or refrigerators. Shinobu et al. (U.S. Pat. No. 5,197,850, Cross Flow Fan System, Mar. 30, 1993) discloses a cross flow type fan having a tongue section.

I have found that none of the exemplar art discloses a cross flow fan that can reduce the noise and vibration produced due to the rotation of the cross flow fan.

SUMMARY OF THE INVENTION

The present invention has been made to overcome the above mentioned problems of the related art, and accordingly, it is an object of the present invention to provide a cross flow fan of an air conditioner capable of significantly reducing the noise produced due to a rotation of the cross flow fan, vibration produced due to an irregularity in the blade arrangement, and even the noise produced in the low frequency range of the cross flow fan.

It is another object to have a cross flow fan that can control a high volume of air without affecting the stability of an air conditioning system.

It is yet another object to have a cross flow fan that is optimally designed to be used in an indoor unit of a separate type air conditioning system.

It is another object to have a cross flow fan that has reduced noise at a high frequency.

In order to accomplish the above object, in a cross flow fan of an air conditioner installed in an indoor unit of the air conditioner and having a plurality of blades functioning to circulate an inside air according to the present invention, the multiple blades are divided into multiple blade groups of a uniform number of blades, however, angles between the two neighboring blades in the same blade group are gradually increased, and blade arrangements are consistent throughout all the blade groups.

In the cross flow fan of the air conditioner according to the present invention, the blade arrangement throughout the blade groups is regular, while the blade arrangement in each blade group is irregular. Accordingly, the noise caused due to the rotation of the cross flow fan is significantly reduced. Further, since the angles between the two neighboring blades in each group are gradually varied in a minimum manner, the noise level in the low frequency range is greatly lowered. Also, since the blades are arranged in a consistent manner throughout all the blade groups, the vibration produced due to the rotation of the cross flow fan and the noise in the low frequency range are significantly reduced. As a result, the noise and vibration characteristics of the cross flow fan in the whole frequency range are significantly improved.

BRIEF DESCRIPTION OF THE DRAWINGS

A more complete appreciation of this invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENT

Figure 1A:
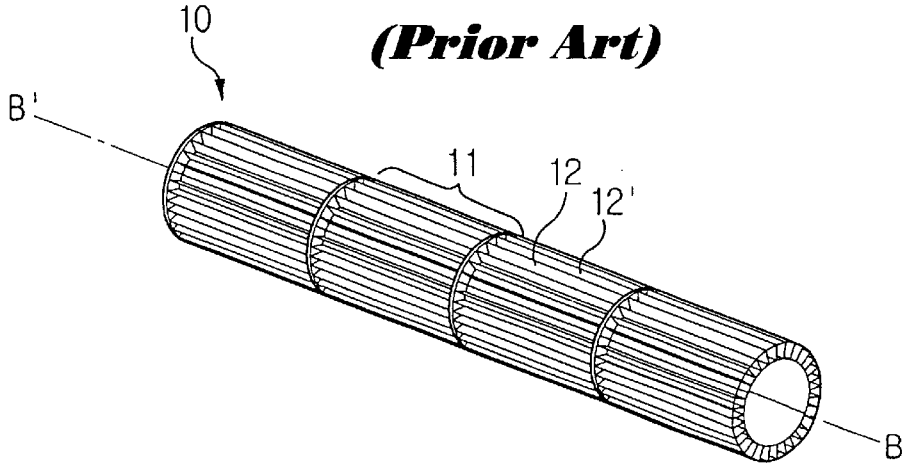
FIG. 1A (Prior Art)
FIG. 1A is a view of a cross flow fan of an air conditioner.
Figure 1B:
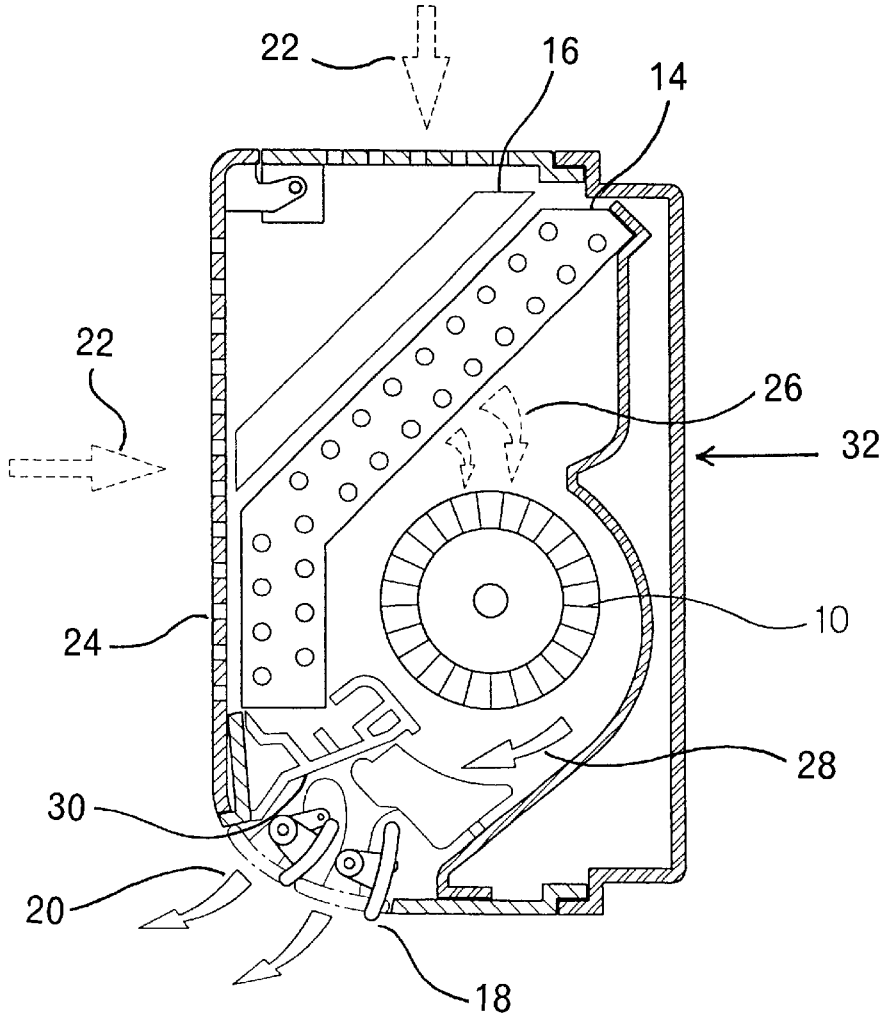
FIG. 1B (Prior Art)
FIG. 1B is a view of a separate type air conditioner in which the cross flow fan of FIG. 1A is installed.

Turning now to the drawings, as seen in FIG. 1B, within an indoor unit 32 the cross flow fan 110 sucks the indoor return air 22 through a grill 24 and then through a filter 16. The air then travels through the evaporator 14. The cross flow fan 10 takes the heat-exchanged air 26 from the evaporator 14 and directs the air 28 toward the air outlet 20. As the air travels from the indoor unit toward the air outlet 20 and the air outlet surface 30, dampers (or vanes) 18 control the air outlet flow 20 that discharges the heat-exchanged air back into the room.

The structure of such a cross flow fan is shown in FIGS. 1A and 1B. FIG. 1A is a view of a cross flow fan of an air conditioner, and FIG. 1B is a view of a separate type air conditioner in which the cross flow fan 10 of FIG. 1A is installed. As shown in FIGS. 1A and 1B, the cross flow fan 10 includes a plurality of sirocco fans (centrifugal multi-blade fans) 11 connected to each other in the direction of a rotational axis (B–B'), and functions to suck the inside air in a perpendicular direction (indicated by dotted line arrow) with respect to the rotational axis (B–B') and to discharge the air in an extended direction (solid line arrow) with respect to the direction that the inside air is sucked. Each of the sirocco fans 11 includes a plurality of blades 12. The blades 12 are arranged concentrically on the cross flow fan 10 at a given interval. Accordingly, the respective blades 12 are spaced from the respective neighboring blades 12' at the central angle of the cross flow fan 10. The intervals between the respective blades 12 are called 'blade pitches'.

Figure 2:
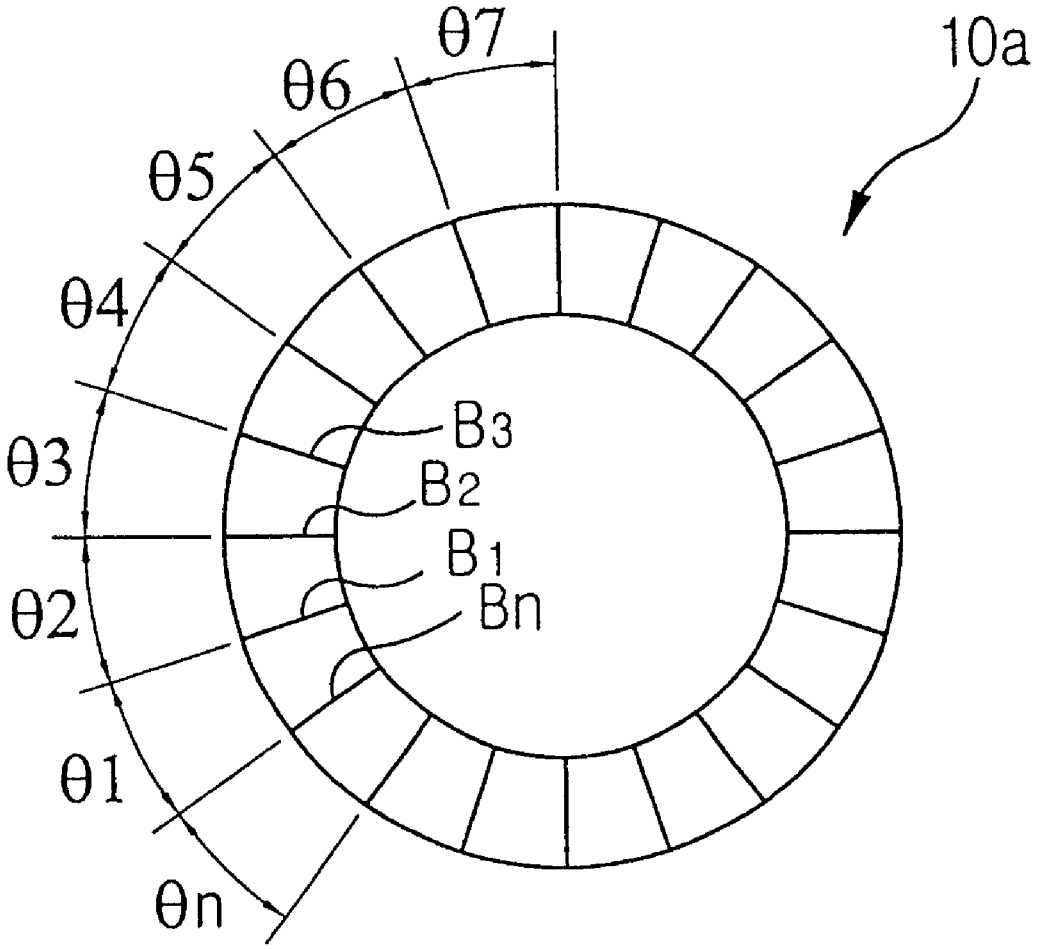
FIG.2 (Prior Art)
FIG. 2 is a view showing the cross flow fan of FIG. 1, viewed from the direction of the rotational axis of the cross flow fan.
Figure 3:
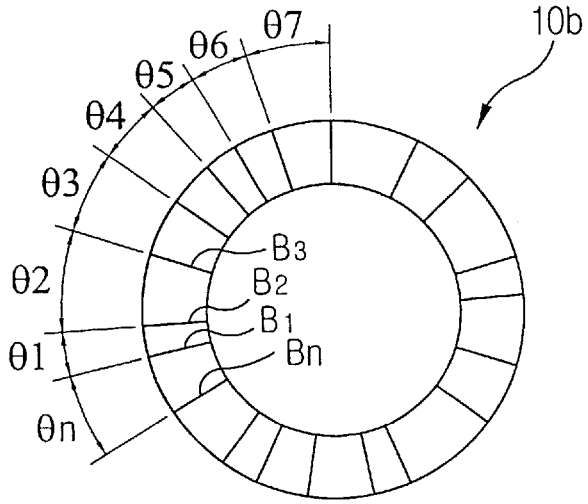
FIG.3 (Prior Art)
FIG. 3 is a view showing a cross flow fan having random pitch, viewed from the direction of the rotational axis of the cross flow fan.
Figure 4:
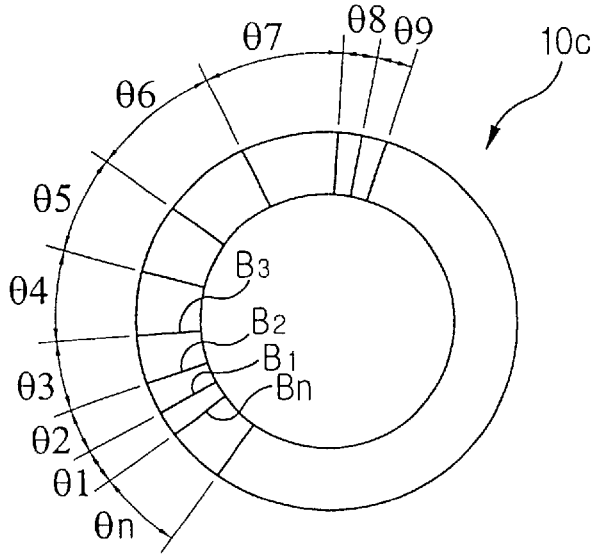
FIG. 4 is a view showing a cross flow fan according to the present invention, which is viewed from the direction of the rotational axis of the cross flow fan.

The blade pitch can be clearly explained with reference to FIGS. 2 to 4, showing the cross flow fan in the direction of the rotational axis (B–B'). Referring to FIGS. 2 to 4, reference symbols '$B_1$, $B_2$, $B_3$, . . . , and $B_n$' refer to the respective blades, and '$\theta_1$, $\theta_2$, $\theta_3$, . . . , and $\theta_n$,' refer to the respective angles between the respective blades $B_1$, $B_2$, $B_3$, . . . , and $B_n$ and the respective clockwise neighboring blades $B_2$, $B_3$, . . . , $B_n$, and $B_1$.

FIGS. 2 and 3 show the blade arrangement on the respective cross flow fans 10*a* and 10*b*. First, the cross flow fan 10*a* of FIG. 2 is called an 'equal pitch fan', in which the blades 12 on the cross flow fan 10*a* are arranged at equal intervals. Accordingly, the relation is expressed by the relational expression of '$\theta_1=\theta_2=\theta_3= \ldots =\theta_n$'. The equal pitch fan 10*a* of the cross flow fan, however, has a considerable noise which is produced due to the rotation of the cross flow fan 10*a*. Meanwhile, the cross flow fan 10*b* shown in FIG. 3 is called a 'random pitch fan', in which the blades are arranged at different intervals. Accordingly, the relation is expressed by a relational expression of '$\theta_1\approx\theta_2\approx\theta_3\approx \ldots \approx\theta_n$'. The random pitch fan 10*b* of the cross flow fan, however, also has a shortcoming in that vibration is produced during its rotation due to an irregularity of the blade arrangement, and the noise is produced even in the low revolution per minute (RPM) range (i.e. low frequency range).

Suggestions have been made to overcome the above-mentioned shortcomings by combining the arrangements in the equal pitch fan and the random pitch fan. These suggestions, however, have not significantly solved the problems, still confirming a need for reducing the noise and vibration produced by the fan.

FIG. 4 shows a blade arrangement in a cross flow fan 10*c* of an air conditioner according to the present invention. The cross flow fan 10*c* is attached to an indoor unit of the air conditioner, functioning to suck the inside air to pass the same through the evaporator, and discharge the heat-exchanged air back into the room. The cross flow fan 10*c* is coupled with a driving source, i.e. a motor.

The blades of the cross flow fan 10*c* according to the present invention are divided into several groups of a uniform number of blades. Here, the angles between the respective blades and the respective neighboring blades in the same blade group are gradually increased, while the pattern of the blade arrangement of the respective groups is uniformly formed throughout the cross flow fan 10*c*.

Meanwhile, the blades in the respective blade groups are arranged at angles increasing with a uniform increment.

The number of the blade groups and the number of blades in the respective blade groups are determined to be the two factors having a minimum difference there between, which are selected from all the factors of the total number of the blades in the blade groups. For example, if the total number of blades is thirty-five (35) in the cross flow fan, then the blades can be divided into five (5) groups of seven (7) blades. Likewise, if the total number of blades is thirty-six (36), then the blades can be divided into six (6) groups of six (6) blades. This is useful for adjusting the regularity and irregularity of the blade arrangement.

Here, the preferred embodiment will be described with reference to FIG. 4 on the assumption that the total number (n) of the blades is thirty-five (35). However, it should be noted that the number of blades is not limited to n=35.

As shown in FIG. 4, the blades on the cross flow fan 10*c* are divided into five groups consisting of seven (7) blades. More specifically, the groups of blades consist of blades $B_1$ to $B_7$, $B_8$ to $B_{14}$, $B_{15}$ to $B_{21}$, $B_{22}$ to $B_{28}$, and $B_{29}$ to $B_{35}$, respectively.

The blades of the respective groups are positioned at respective angles of $\theta_1$ to $\theta_7$, $\theta_8$ to $\theta_{14}$, $\theta_{15}$ to $\theta_{21}$, $\theta_{22}$ to $\theta_{28}$, and $\theta_{29}$ to $\theta_{35}$, in a manner that the angles between the respective blades and the respective neighboring blades, the angle between $\theta_1$ and $\theta_2$ for instance, should be increased in a minimum manner. Also, the pattern of the blade arrangement throughout the cross flow fan is uniformly formed.

Further, the angles between the respective blades and the respective neighboring blades in each blade group are increased with a uniform increment.

Thus, the blade arrangement can be expressed by the following relational expressions;

"$\theta_1=\theta_8=\theta_{15}=\theta_{22}=\theta_{29}$",

"$\theta_2=\theta_9=\theta_{16}=\theta_{23}=\theta_{30}=\theta_1+\alpha$",

"$\theta_3=\theta_{10}=\theta_{15}=\theta_{24}=\theta_{31}=\theta_1+2\alpha$",

"$\theta_4=\theta_{11}=\theta_{15}=\theta_{25}=\theta_{32}=\theta_1+3\alpha$",

"$\theta_5=\theta_{12}=\theta_{15}=\theta_{26}=\theta_{33}=\theta_1+4\alpha$",

"$\theta_6=\theta_{13}=\theta_{15}=\theta_{27}=\theta_{34}=\theta_1+5\alpha$",

"$\theta_7=\theta_8=\theta_{15}=\theta_{28}=\theta_{35}=\theta_1+6\alpha$",

"$\theta_1+\theta_2+\theta_3+\theta_4+\theta_5+\theta_6+\theta_7=$ $\theta_8+\theta_9+\theta_{10}+\theta_{11}+\theta_{12}+\theta_{13}+\theta_{14}=$ $\theta_{15}+\theta_{16}+\theta_{17}+\theta_{18}+\theta_{19}+\theta_{20}+\theta_{21}=$ $\theta_{22}+\theta_{23}+\theta_{24}+\theta_{25}+\theta_{26}+\theta_{27}+\theta_{28}=$ $\theta_{29}+\theta_{30}+\theta_{31}+\theta_{32}+\theta_{33}+\theta_{34}+\theta_{35}=72°$"

"$\alpha$" can be obtained when the value for "$\theta_1$" is set. Supposing "$\theta_1$" as 10° for instance, "$\alpha$" is obtained by the relational expression; "$\theta_1+\theta_2+\theta_3+\theta_4+\theta_5+\theta_6+\theta_7=7\theta_1+21\alpha=72°$". 72° is obtained by dividing 360° (angle of a circumference of a circle) by 5 (five groups) equaling 72°. Accordingly, the value of "$\alpha$" is, "$\alpha=2/21\approx0.095°$". Also, with expressions of "$\alpha=(72-7\theta_1)/21>0$", and "$\theta_1<10.28°$ (=72°/7)", "$\theta_1$," can be obtained. Meanwhile, the lowest value of "$\theta_1$" should be determined considering the fact that the "$\alpha$" is far less than "$\theta_1$".

In the cross flow fan constructed as above according to the present invention, the angle between two neighboring blades in each blade group is gradually varied in a minimum manner, while the angle of the two neighboring blades at the boundary area of the respective groups is varied by a relatively greater degree. In other words, the blade arrangement in each group is irregular, while the blade arrangement in all the groups as a whole is uniform.

Figure 5:
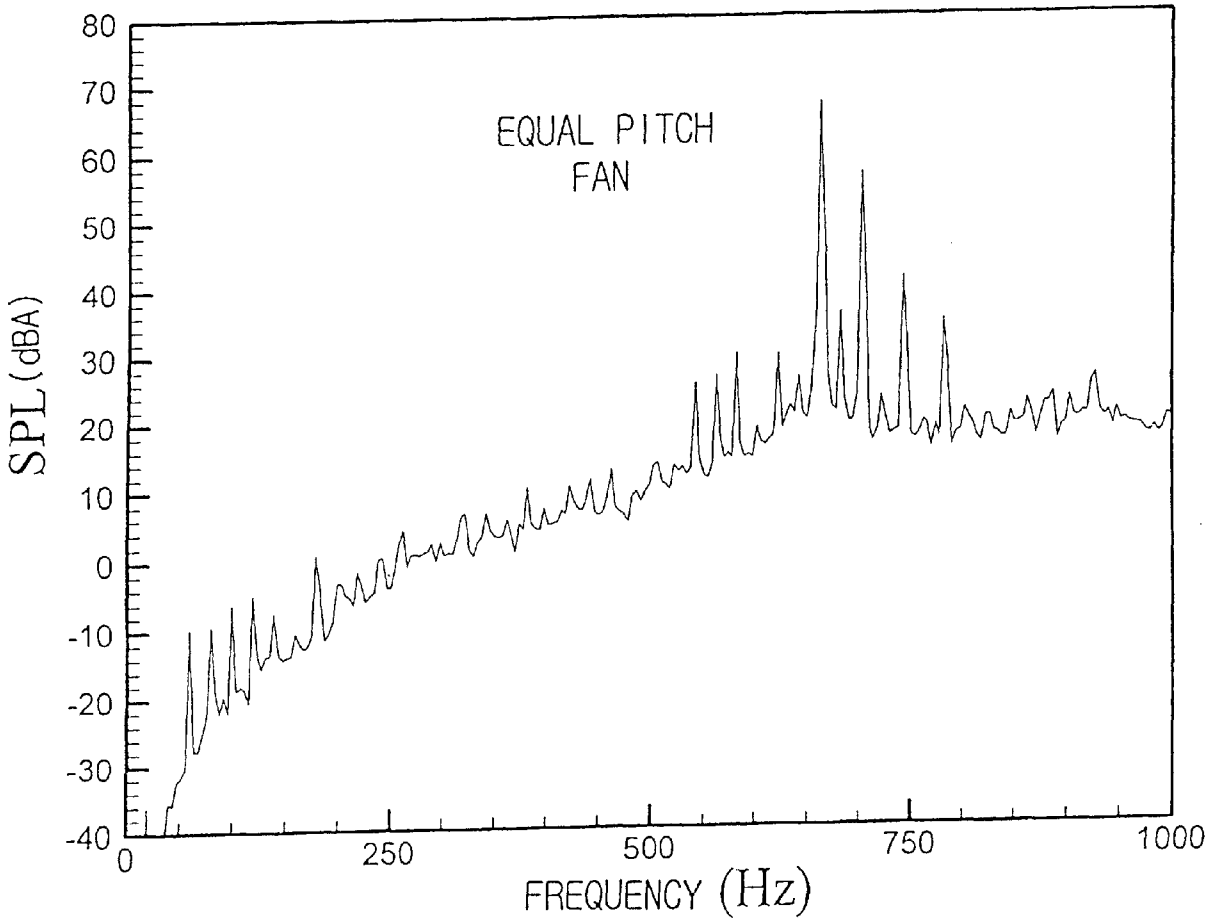
FIG. 5 (Prior Art)
FIG. 5 is a graph for illustrating the noise level of the cross flow fan of FIG. 2 during its rotation.
Figure 6:
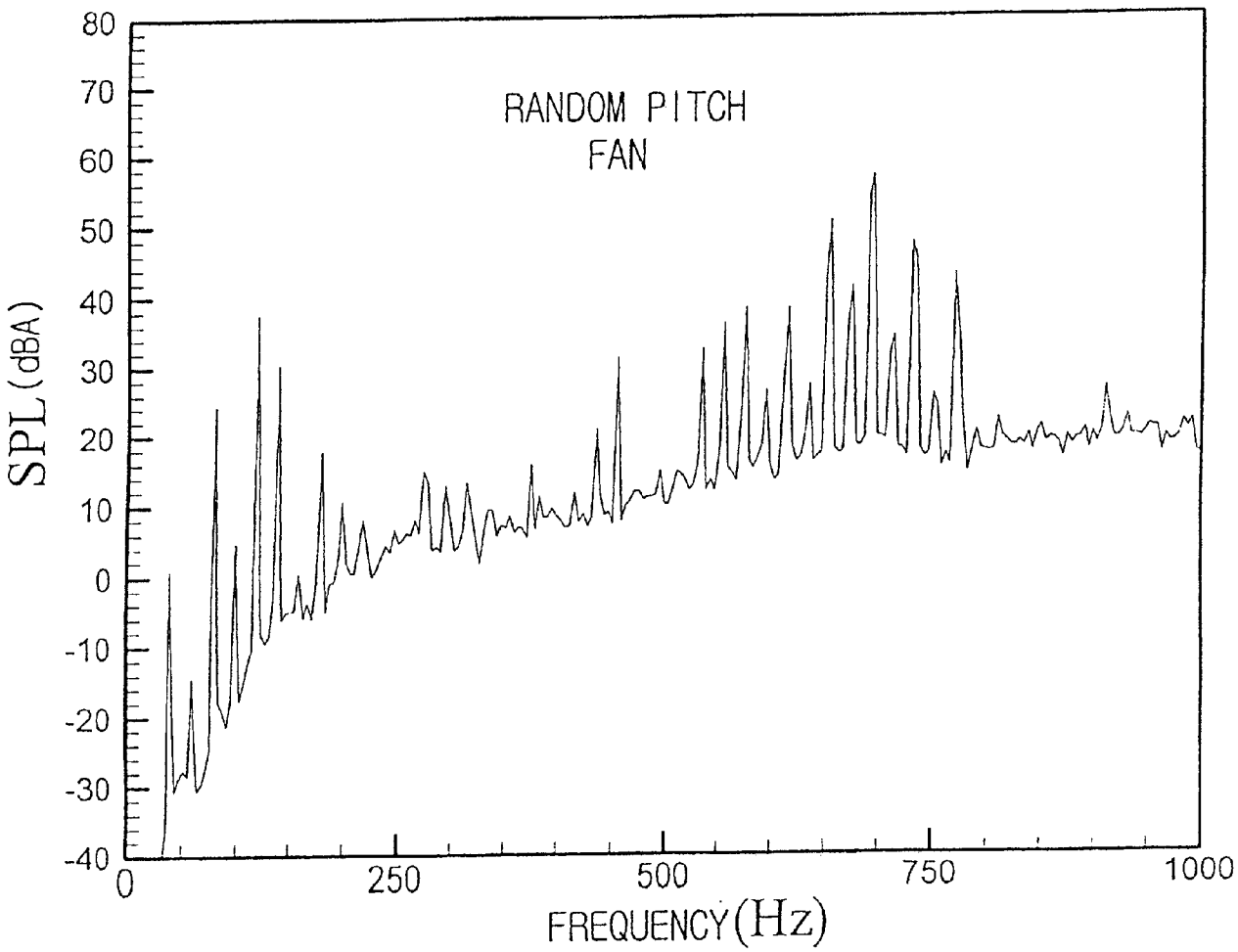
FIG. 6 is a graph for illustrating the noise level of the cross flow fan of FIG. 3 during its rotation.
Figure 7:
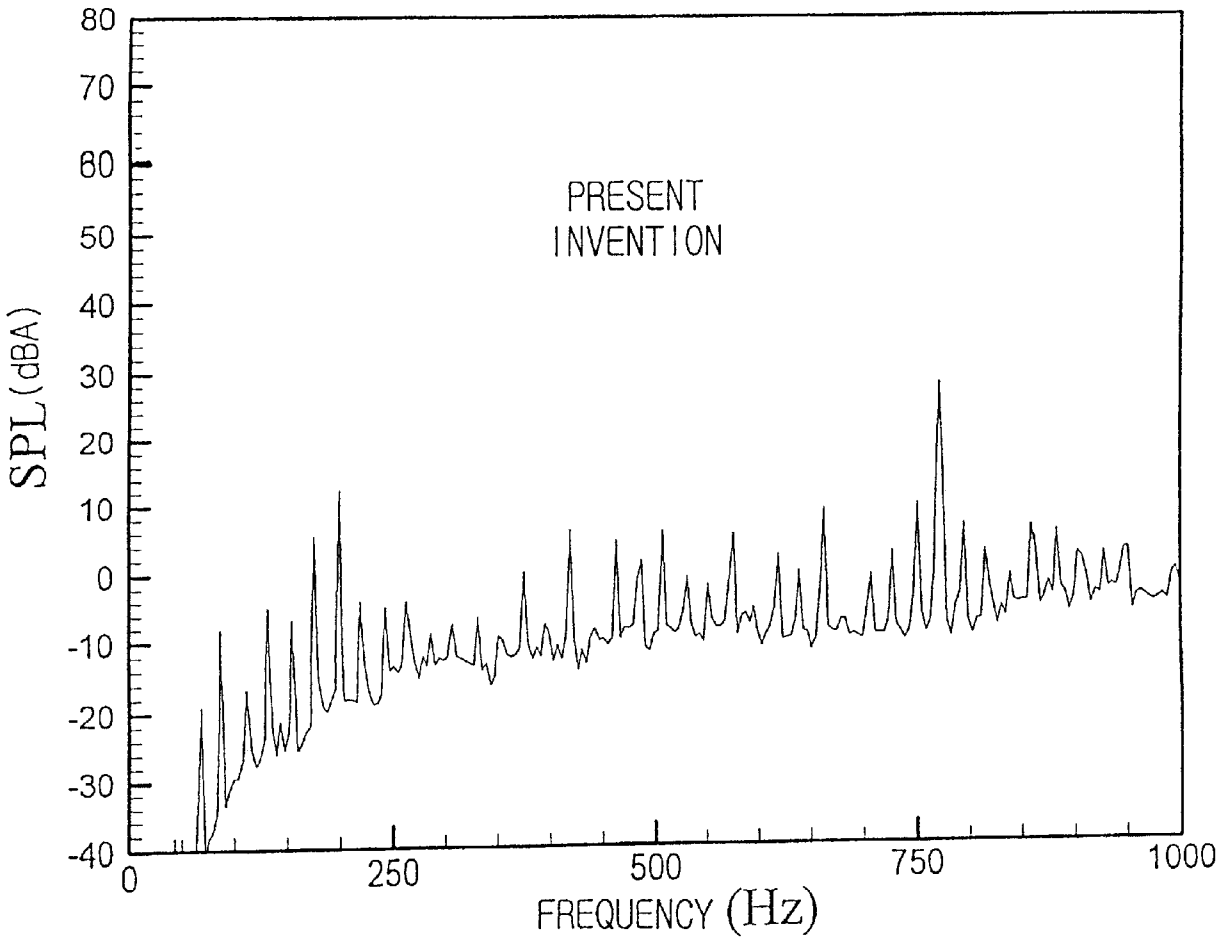
FIG. 7 is a graph for illustrating the noise level of the cross flow fan according to the present invention during its rotation.

FIGS. 5 to 7 are graphs for illustrating the noise level in accordance with the RPM (frequency in revolutions per minute) of the cross flow fan according to the equal pitch fan, the random pitch fan and the present invention, in which the noise characteristics of the present invention are proven to be superior to the noise characteristics of the equal pitch and random pitch fans. In the respective graphs, the horizontal axis is for frequency (Hz), and the vertical axis is for the Sound Pressure Level (dBA).

FIG. 5 is a graph for illustrating the Sound Pressure Level (dBA) of the equal pitch fan of the cross flow fan, and FIG. 6 is a graph for illustrating the Sound Pressure Level (dBA) of the random pitch fan of the cross flow fan. As indicated in FIGS. 5 and 6, the sound level is high, mostly ranging from 0 dBA to the maximum of 70 dBA. Particularly, the random pitch fan shows a relatively higher noise level reaching 40 dBA even in the low frequency range.

In contrast, as shown in FIG. 7, the noise level of the cross flow fan according to the present invention stays within 0 dBA, with the maximum level of 30 dBA.

As described above, by the characteristic structure of the present invention, the noise and vibration are significantly reduced in comparison with the level of noise and vibration of the equal pitch and random pitch fans.

In the cross flow fan of the air conditioner according to the present invention, the blade arrangement throughout the blade groups is regular, while the blade arrangement in each blade group is irregular. Accordingly, the noise caused due to the rotation of the cross flow fan is significantly reduced. Further, since the angles between the two neighboring blades in each group are gradually varied in a minimum manner, the noise level in the low frequency range is greatly lowered. Also, since the blades are arranged in a consistent manner throughout all the blade groups, the vibration produced due to the rotation of the cross flow fan and the noise in the low frequency range are significantly reduced. As a result, the noise and vibration characteristics of the cross flow fan in the whole frequency range are significantly improved.

While the present invention has been particularly disclosed with reference to the preferred embodiment thereof, it will be understood by those skilled in the art that various changes in form and details may be affected therein without departing from the spirit and scope of the invention as defined by the appended claims.

What is claimed is:

1. A cross flow fan of an air conditioner, comprising a plurality of blades divided into a plurality of blade groups of a uniform number of blades having angles between two neighboring blades in the same blade group being gradually increased, and blade arrangements being consistent throughout all the blade groups, said plurality of blades of said cross flow fan functioning to circulate an inside air when installed in an indoor unit of the air conditioner.

2. The cross flow fan of claim 1, wherein said blades in each blade group having the angle between the blades increase with a uniform angle increment.

3. The cross flow fan of claim 1, wherein a predetermined total number of said plurality of blades in said cross flow fan being equal to a product of the number of blade groups with a number of said blades in each group and having a minimal difference between the number of said blades in each group and the number of blade groups.

4. The cross flow fan of claim 2, wherein a predetermined total number of said plurality of blades in said cross flow fan being equal to a product of the number of blade groups with a number of said blades in each group and having a minimal difference between the number of said blades in each group and the number of blade groups.

5. The cross flow fan of claim 4, wherein the total number of said blades is 35 being divided into 5 groups of 7 blades.

6. The cross flow fan of claim 5, wherein the angles between the blades in the respective blade groups start from 10°, and increase approximately by 0.095°.

7. The cross flow fan of claim 6, wherein said blades being arranged concentrically and circumscribing a cylindrical shaft.

8. The cross flow fan of claim 7, further comprising a plurality of said cross flow fans being connected together in a direction of a rotational axis of the cylindrical shaft.

9. The cross flow fan of claim 8, wherein a predetermined angle being between a last blade of a first group of blades and a first blade of an adjacent second group of blades, angles between following blades of the second group of blades being progressively incremented from the predetermined angle by a set incremental angle.

10. The cross flow fan of claim 9, wherein the predetermined angle being less than an angle of a circumference of a circle divided by the number of the groups of blades.

11. A cross flow fan of an air conditioner, comprising a plurality of blades divided into a plurality of blade groups of a uniform number of blades having different angles between each of two adjacent blades, and blade arrangements in the blade groups being equal to each other, said plurality of blades of said cross flow fan functioning to circulate an inside air and being installed in an indoor unit of a separate type of air conditioner.

12. The cross flow fan of claim 11, wherein said blades in each blade group having the angle between the blades increase with a uniform angle increment.

13. The cross flow fan of claim 12, wherein the total number of said blades is 35 being divided into 5 groups of 7 blades.

14. The cross flow fan of claim 13, wherein the angles between the blades in the respective blade groups start from 10°, and increase approximately by 0.095°.

15. The cross flow fan of claim 11, wherein a predetermined total number of said plurality of blades in said cross flow fan being equal to a product of the number of blade groups with a number of said blades in each group and having a minimal difference between the number of said blades in each group and the number of blade groups.

16. The cross flow fan of claim 11, wherein said blades being arranged concentrically and circumscribing a cylindrical shaft.

17. The cross flow fan of claim 16, further comprising a plurality of said cross flow fans being connected together in a direction of a rotational axis of the cylindrical shaft.

18. The cross flow fan of claim 11, wherein a predetermined angle being between a last blade of a first group of blades and a first blade of an adjacent second group of blades, angles between following blades of the second group of blades being progressively incremented from the predetermined angle by a set incremental angle, the predetermined angle being less than an angle of a circumference of a circle divided by the number of the group of blades.

19. A method, comprising the steps of:

forming concentrically a plurality of blades circumscribing a cylinder of a cross flow fan of an air conditioner;

grouping an equal number of said blades;

progressively incrementing an angle in a uniform manner between each one of said blades within each group of said blades, all of the groups of blades having a same arrangement pattern of said blades; and installing said cross flow fan in an indoor unit next to an evaporator, said plurality of blades of said cross flow fan circulating an inside air.

20. The method of claim 19, wherein said grouping of said blades having a minimal difference between the number of said blades in each group and the number of groups of blades, a total number of said blades being equal to a product of the number of group of blades with a number of said blades in each group.

* * * * *